US006059167A

United States Patent [19]

Ho et al.

[11] Patent Number: 6,059,167

[45] Date of Patent: May 9, 2000

[54] END BASE OF A POWER STAPLER

[75] Inventors: Roman Ho; Jack Chen; Hsuam-Chi Chiang, all of Taichung, Taiwan

[73] Assignee: Basso Industry Corp., Taichung, Taiwan

[21] Appl. No.: 09/431,373

[22] Filed: Nov. 1, 1999

[51] Int. Cl.[7] ..... B25C 1/04

[52] U.S. Cl. ..... 227/130

[58] Field of Search ..... 227/8, 130

[56] References Cited

U.S. PATENT DOCUMENTS

| | | | |
|---|---|---|---|
| 5,110,030 | 5/1992 | Tanji | 227/130 |
| 5,259,465 | 11/1993 | Mukoyama | 227/130 |
| 5,485,946 | 1/1996 | Jankel | 227/130 |
| 5,715,986 | 2/1998 | Sauer | 227/130 |
| 5,782,395 | 7/1998 | Sauer | 227/130 |
| 5,881,941 | 3/1999 | Lai | 227/130 |
| 5,927,584 | 7/1999 | Akiba | 227/130 |

*Primary Examiner*—Scott A. Smith
*Attorney, Agent, or Firm*—Charles E Baxley, Esq.

[57] ABSTRACT

A power stapler includes a barrel with a cylinder received therein and a piston is movably received in the cylinder. An end cap is connected to the rear end of the barrel and a frame is movably engaged with the inside of the end cap. A seal part is engaged with an annular space in the outside of the frame and contacts the cylinder. A plurality of passages are defined through the frame and communicate with the annular space so that the seal part is securely positioned because the pressure in the passages is lower than the outside of the seal part. A fixed member is connected to the end cap and a pad is engaged with the fixed member. The pad has notches in the distal end thereof which contacts the piston so that air trapped between the pad and piston is released via the notches when the piston moves back to the original position after a shot.

5 Claims, 5 Drawing Sheets

END BASE OF A POWER STAPLER

FIELD OF THE INVENTION

The present invention relates to a power stapler, and more particularly, to an end base for a power stapler wherein the end base of the invention occupies less volume and wearing of the sealing parts is reduced.

BACKGROUND OF THE INVENTION

An end base structure of a conventional power stapler is shown in FIG. 1 and includes a cylinder 16 in the barrel 15 of the power stapler and a piston 18 with a piston rod 19 movably received in the cylinder 16. An end cap 11 is mounted to the rear end of the barrel 15 and has two tubular portions 110, 112 so that a frame 12 is movably engaged between the inside 111 of the tubular portion 110 and the outside of the other tubular portion 112. A seal part 120 is connected to the frame 12 and contacts against the distal end of the cylinder 16 so as to prevent high pressurized air from entering the cylinder 16 when the trigger (not shown) of the power stapler is not yet pulled. Two seals 125, 126 are respectively mounted to the frame 12 and engaged with the two tubular portions 110, 112. A flange 161 extends radially outward from the cylinder 16 and is engaged with the inside of the end cap 11. A fixed member 17 is enclosed by the tubular portion 112 and has a protrusion 17 extending toward the cylinder 16. A spring 13 is biased between the frame 12 and the fixed member 17 so as to push the frame 12 back to the cylinder 16 after the trigger is pulled. The piston 18 has a protrusion portion which extends through a central hole in the frame 12 and contacts the end surface 170 of the protrusion 17 of the fixed member 17.

When the user pulls the trigger, the frame 12 is moved away from the cylinder 16 to let pressurized air enter the cylinder 16 to eject the piston 18. After the piston 18 is ejected, the spring 13 pushes the frame 12 back to the cylinder 16 and the protrusion portion of the piston 18 will impact the end surface 170 of the protrusion 17 of the fixed member 17. An inherent shortcoming of the conventional power stapler is that the seals 125, 126, the seal part 120 and the end surface 170 of the fixed member 17 will be worn out for the frequent movements of the frame 12 and the piston 18. Leakage could happen between the surface and the seals 125, 126, and between the distal end of the cylinder 16 and the seal part 120.

The present invention intends to provide an end base of a power stapler wherein the frame has passages communicating with annular space where the seal part is engaged so as to form a lower pressure area at the inside of the seal part to securely position the seal part on the frame. The fixed member is not directly connected to the frame so that the movement of the frame is independent from the impact between the piston and the fixed member. The present invention has arisen to mitigate and obviate the disadvantages of the conventional power stapler.

SUMMARY OF THE INVENTION

In accordance with one aspect of the present invention, there is provided an end base of a power stapler and comprising a collar having a flange extending from a first side thereof so as to be engaged with a pad. The second side of the collar is fixedly connected to the end cap. A skirt extends from the pad and encloses a protrusion of the piston, and a distal end of the skirt of the pad contacts the piston.

A frame is movably engaged with the end cap and a seal part is received in an annular space defined in an outside of the frame, wherein the seal part contacts the cylinder when the trigger is not yet pulled. A plurality of passages are defined radially through the frame and communicate with the annular space so that a lower pressure area is defined at the inside of the seal part. A spring is biased between the end cap and the frame.

The object of the present invention is to provide a power stapler wherein the seal part is securely positioned by the pressure difference at the inside and the outside of the seal part so that the volume of the seal part can be reduced and will not drop from the frame during the movement of the frame.

Another object of the present invention is to provide a power stapler wherein the air trapped in the pad is quickly released when the piston moves toward the pad so that the piston is moved smoothly and efficiently.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
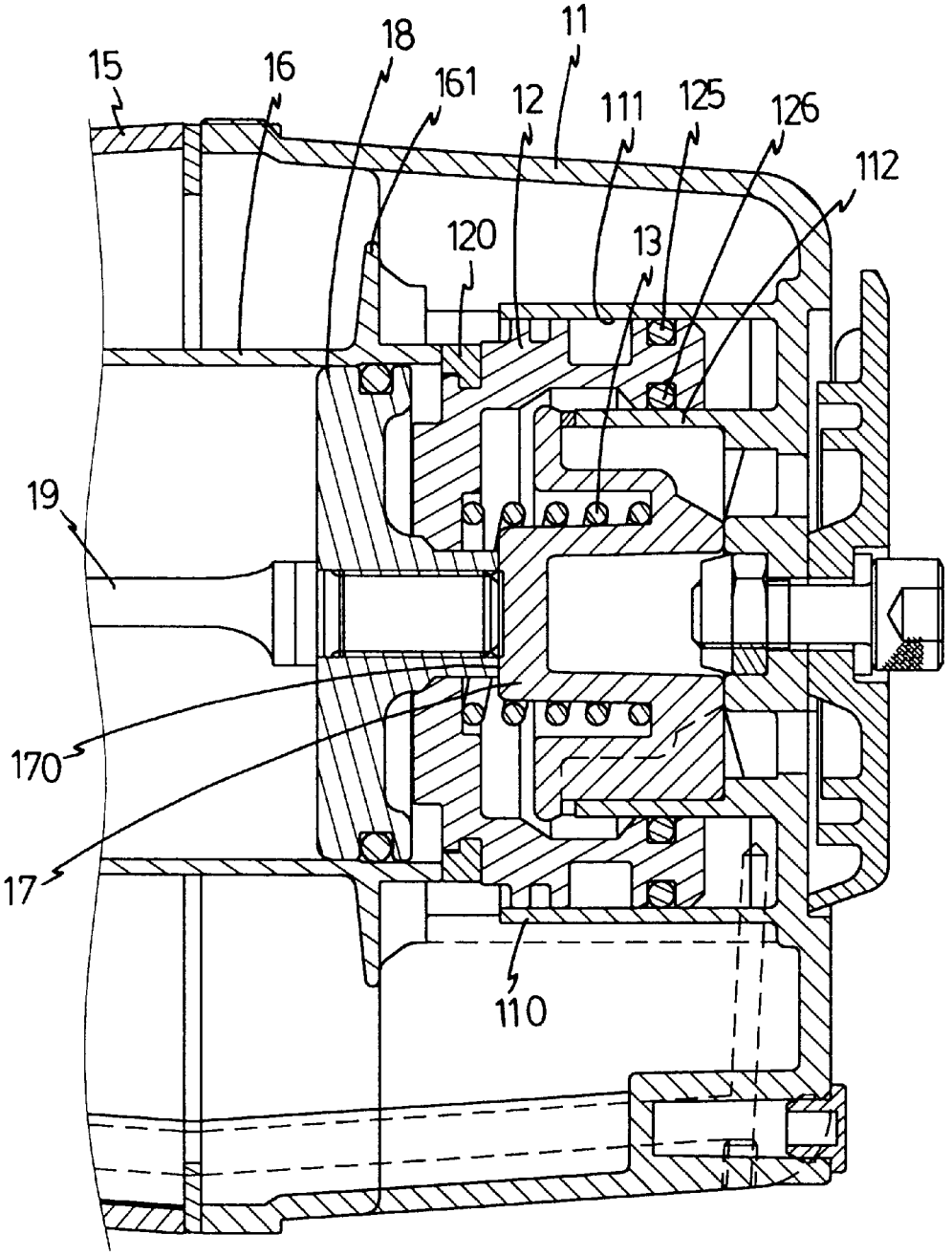
F I G.1 PRIOR ART
FIG. 1 is a side elevational view, partly in section, of the structure of the end base of a conventional power stapler.
Figure 2:
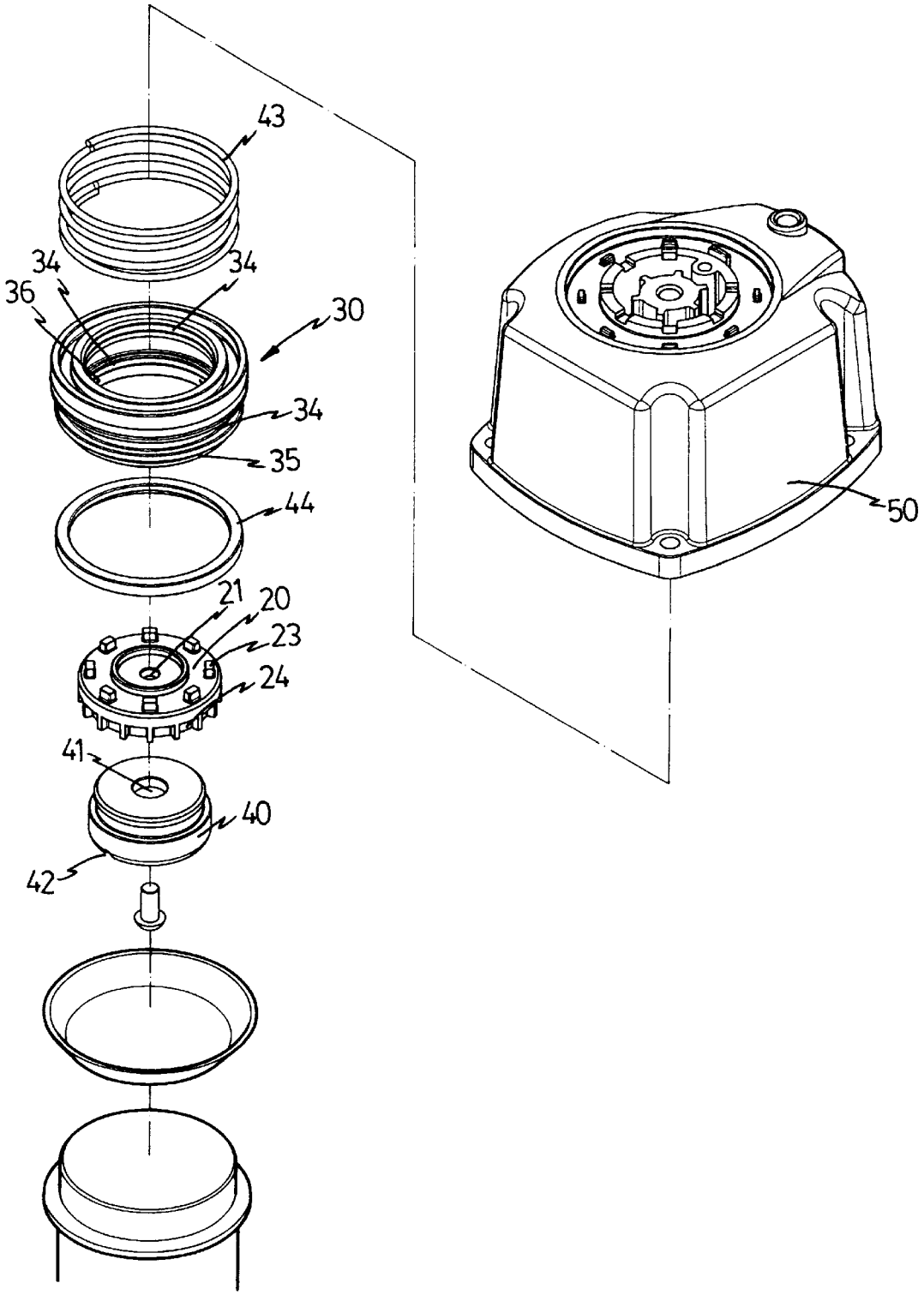
FIG. 2 is an exploded view of the end base of the power stapler in accordance with the present invention.
Figure 3:
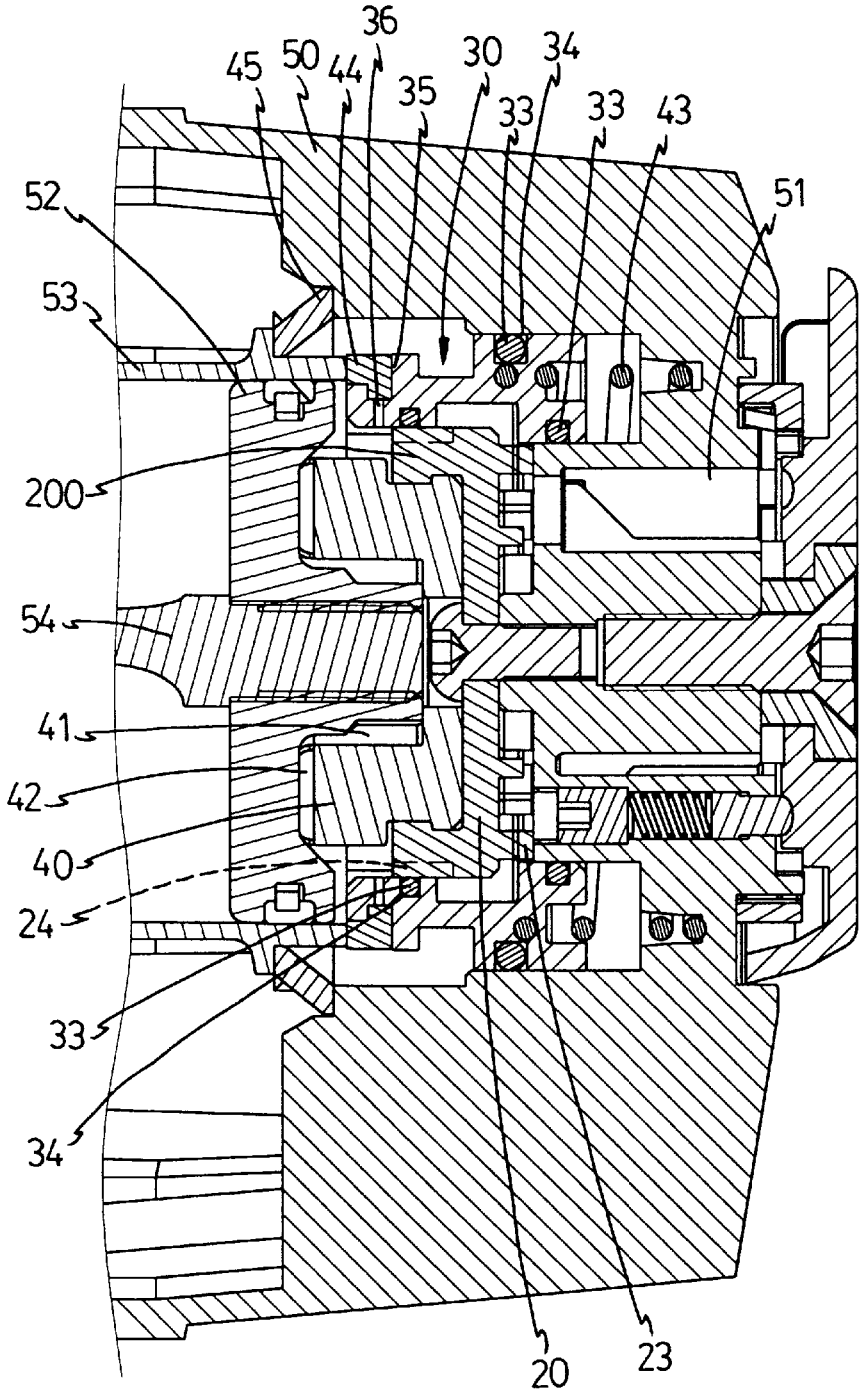
FIG. 3 is a side elevational view, partly in section, of the end base in accordance with the present invention, wherein the piston is in its ready position.

For a better understanding of the present invention, reference is made to FIGS. 2 and 3, the power stapler has a barrel in which a cylinder 53 is received, a piston 52 movably received in the cylinder 53 and having a protrusion as shown in FIG. 3. A piston rod 54 extends from the piston 52 so as to eject a staple when the user pulls the trigger (not shown). An end cap 50 is mounted to the rear end of the barrel and encloses the end base. A collar member 45 is a flexible member and engaged between the cylinder 53 and the inside of the end cap 50 so as to prevent the pressurized air from leaking into the space between the barrel and the cylinder 53.

A collar 20 has a flange 200 extending from a first side of the collar 20 and the collar 20 is fixedly connected to the end cap 50 at a second side of the collar 20 by a bolt extending through a center hole 21 in the collar 20. A plurality of bosses 23 extend from the second side of the collar 20 so that there is a gap between the collar 20 and the end cap 50 that is connected to the second side of the collar 20. The flange 200 has ribs extending radially outward therefrom so as to define a plurality of recessed partitions 24 separated by the ribs.

A frame 30 is movably engaged between the inside of the end cap 50 and the outside of the collar 20. Seals 33, 43 are respectively mounted to the frame 30 and an annular space 35 is defined in the outside of the frame 30 near the first end of the collar 20. A seal part 44 is engaged with the annular space 35 and removably contacts an end of the cylinder 53 when the piston 52 is in its ready position. A plurality of passages 36 are defined radially through the frame 30 and communicate with the annular space 35 where the seal part 44 is engaged so that when the trigger is not yet pulled, the pressure in the passages 36 is a lower pressure area and the space outside of the seal part 44 is a high pressure area so that the seal part 44 is firmly compressed in the annular space 35 without any play even in the process of movement of the frame 30. A spring 43 is biased between the end cap 50 and the frame 30 so compress the frame 30 to contact the cylinder 53.

A pad 40 is connected to an inside of the flange 200 of the collar 20 and a skirt extending from the pad 40 so as to enclose the protrusion 520 of the piston 52 in the space 41 enclosed by the skirt. The distal end of the skirt of the pad 40 contacts the piston 52 when the piston 52 is in its ready position. The distal end of the skirt of the pad 40 has a recessed area 42 defined therein and the recessed area 42 radially communicates with the interior of the cylinder 53.

Figure 4:
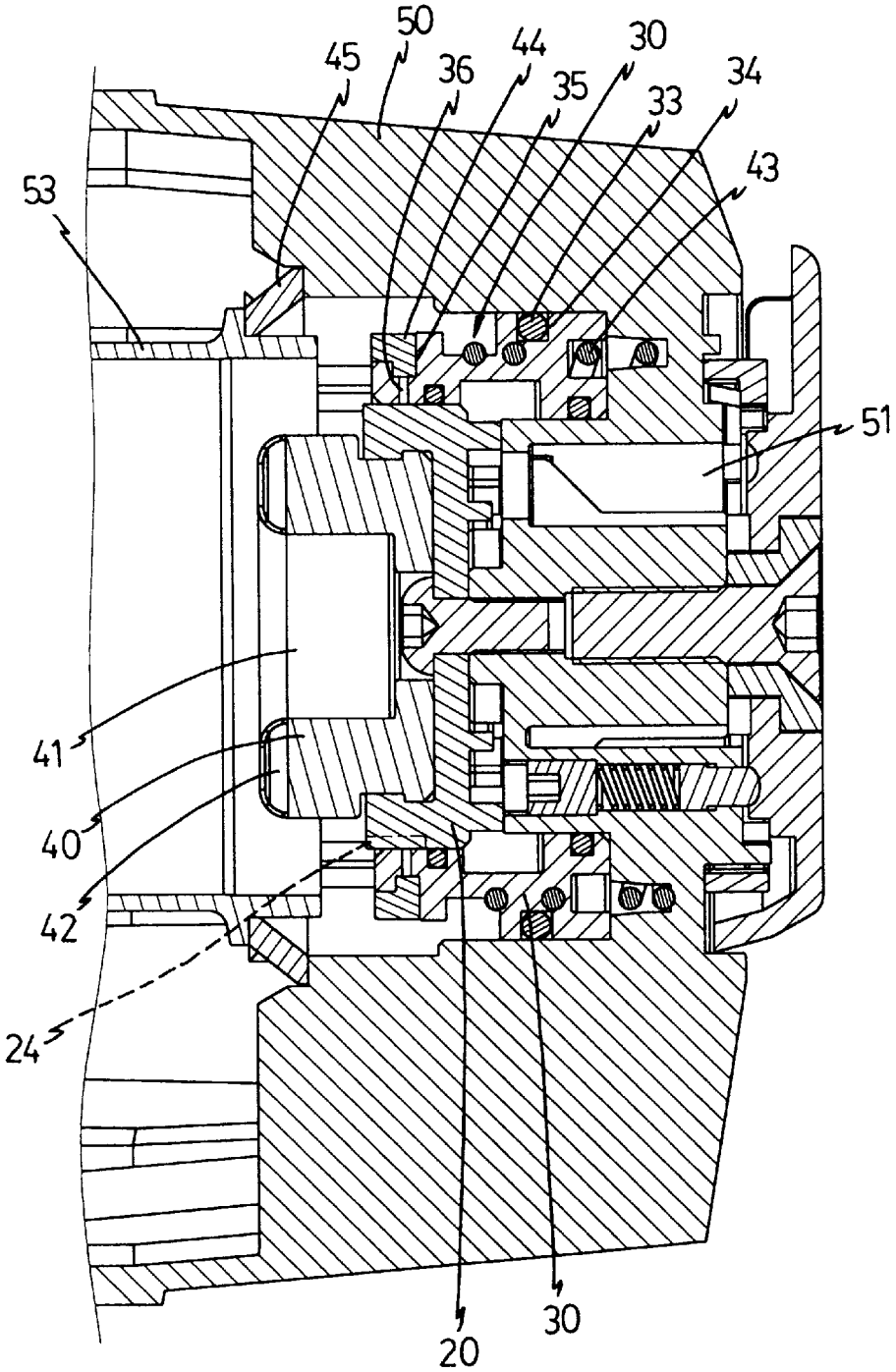
FIG. 4 is a side elevational view, partly in section, of the end base in accordance with the present invention, wherein the piston moves away from the pad when the trigger is pulled.

Referring to FIG. 4, when the user pulls the trigger, the frame 30 is moved away from the cylinder 53 and the pressurized air enters the cylinder 53 so that the piston 52 is pushed to eject a staple. The frame 30 is moved to a position where the passages 36 communicate with the recessed partitions 24. The frame 30 is then pushed by the spring 43 and the seal part 44 contacts the cylinder 53 again. The piston 52 moves back to expel the air in the cylinder 53 via the exhausted air duct 51 and the air trapped in the space 41 is released from the recessed area 42. Therefore, the piston 52 is moved smoothly without resistance from the air trapped in the space 41 of the pad 40.

The pad 40 is not directly connected to the frame 30 so that the impact of the piston 52 to the pad 40 will not affect the frame 30. The seal part 44 is firmly received in the annular space 35 in the frame 30 by the pressure difference on two sides of the seal part 44 so that the seal part 44 and the diameter of the cylinder 53 can be reduced as needed.

Figure 5:
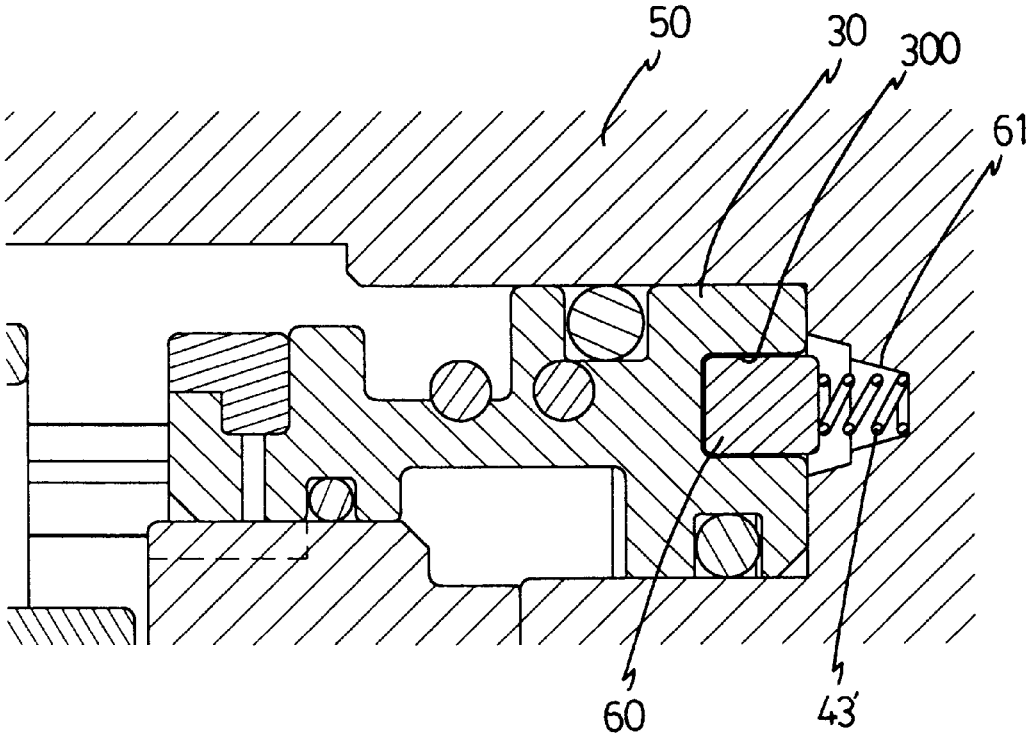
FIG. 5 is a side elevational view, partly in section, of another embodiment of the installation of the spring between the frame and the end cap of the power stapler of the present invention.

Referring to FIG. 5, in order to reduce the wear of the spring 43 contacting with the frame 30, the frame 30 may have a plurality of notches 300 defined in an end thereof opposite to the seal part 44. Each notch has a block 60 received therein and the spring 43' connected to the blocks 60. The other end of each spring 43' is received in a corresponding hole 61 in the end cap 50 so that the there will be no wearing between the springs 43' and the frame 20.

While we have shown and described various embodiments in accordance with the present invention, it should be clear to those skilled in the art that further embodiments may be made without departing from the scope and spirit of the present invention.

What is claimed is:

1. An end base of a power stapler which has a barrel and a cylinder is received in the barrel, a piston movably received in the cylinder, an end cap mounted to the barrel, said end base comprising:

a collar having a flange extending from a first side of said collar and said collar adapted to be fixedly connected to the end cap at a second side of said collar;

a pad connected to an inside of said flange of said collar, a skirt extending from said pad and adapted to enclose a protrusion of the piston, a distal end of said skirt of said pad adapted to contact the piston;

a frame adapted to be movably engaged with the end cap, an annular space defined in an outside of said frame and a seal part engaged with said annular space, a plurality of passages defined radially through said frame and communicating with said annular space where said seal part is engaged, said seal part adapted to removably contact the cylinder, and a spring adapted to be biased between the end cap and said frame.

2. The end base as claimed in claim 1, wherein a distal end of said skirt of said pad has a recessed area defined therein and said recessed area adapted to radially communicate with an interior of the cylinder.

3. The end base as claimed in claim 1 further comprising a collar member which is adapted to be engaged between the cylinder and the end cap.

4. The end base as claimed in claim 1, wherein said frame has a plurality of notches defined in an end thereof opposite to said seal part, each notch having a block received therein and said spring connected to said blocks.

5. The end base as claimed in claim 1, wherein said flange has ribs extending radially outward therefrom so as to define a plurality of recessed partitions separated by said ribs, said recessed partitions communicating with said passages in said frame when said frame is moved away from said cylinder.

* * * * *